US010226938B2

(12) United States Patent
Bayona et al.

(10) Patent No.: US 10,226,938 B2
(45) Date of Patent: Mar. 12, 2019

(54) IDENTIFYING FIRST AND SECOND RESERVOIR STATUSES

(71) Applicant: HEWLETT-PACKARD DEVELOPMENT COMPANY, L.P., Houston, TX (US)

(72) Inventors: Fernando Bayona, Terrassa (ES); Michel Georges Encrenaz, Rubi (ES); Albert Crespi, Sant Cugat del Valles (ES); Joan-Albert Miravet, Barcelona (ES); Bhishma Hernandez Martinez, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/544,597

(22) PCT Filed: Mar. 13, 2015

(86) PCT No.: PCT/US2015/020372

§ 371 (c)(1),
(2) Date: Jul. 19, 2017

(87) PCT Pub. No.: WO2016/148672

PCT Pub. Date: Sep. 22, 2016

(65) Prior Publication Data

US 2017/0355198 A1 Dec. 14, 2017

(51) Int. Cl.
*B41J 2/175* (2006.01)

(52) U.S. Cl.
CPC ..... *B41J 2/17566* (2013.01); *B41J 2/175* (2013.01); *B41J 2/17596* (2013.01)

(58) Field of Classification Search
CPC .... B41J 2/175; B41J 2/17596; B41J 2/17566; B41J 2/17506
See application file for complete search history.

(56) References Cited

U.S. PATENT DOCUMENTS

| | | | | |
|---|---|---|---|---|
| 5,880,748 | A * | 3/1999 | Childers | B41J 2/175 347/6 |
| 5,912,688 | A | 6/1999 | Gragg | |
| 6,802,581 | B2 | 10/2004 | Hasseler et al. | |
| 7,147,301 | B2 | 12/2006 | Powers et al. | |
| 7,494,215 | B2 | 2/2009 | Stellbrink | |
| 8,235,494 | B2 * | 8/2012 | Kaiho | B41J 2/155 347/17 |
| 8,529,038 | B2 | 9/2013 | Leighton et al. | |
| 2006/0001684 | A1 * | 1/2006 | Papaiacovou | B41J 2/175 347/7 |

(Continued)

FOREIGN PATENT DOCUMENTS

| | | |
|---|---|---|
| CN | 101052530 | 10/2007 |
| CN | 101152798 | 4/2008 |

(Continued)

*Primary Examiner* — John P Zimmermann
(74) *Attorney, Agent, or Firm* — HP Inc. Patent Department

(57) ABSTRACT

An example device in accordance with an aspect of the present disclosure includes a first reservoir for a printable composition, a pump fluidically coupled to the first reservoir and a second reservoir, a sensor, and a controller. The controller is to identify first and second reservoir statuses based on the sensor.

20 Claims, 6 Drawing Sheets

(56) References Cited

U.S. PATENT DOCUMENTS

| | | | | |
|---|---|---|---|---|
| 2006/0050112 | A1 | 3/2006 | Moynihan | |
| 2006/0061638 | A1 | 3/2006 | Amarume et al. | |
| 2007/0263020 | A1 | 11/2007 | Bradford et al. | |
| 2008/0079791 | A1 | 4/2008 | Kang et al. | |
| 2010/0079562 | A1 | 4/2010 | Katada et al. | |
| 2010/0194798 | A1 | 8/2010 | Asami et al. | |
| 2010/0259587 | A1 | 10/2010 | Uptergrove | |
| 2012/0268507 | A1 | 10/2012 | Asami | |
| 2012/0281035 | A1 | 11/2012 | Uptergrove | |
| 2013/0257941 | A1 | 10/2013 | Thoshiba | |
| 2014/0225964 | A1 * | 8/2014 | Cyman, Jr. ..... | B41J 2/175<br>347/86 |

FOREIGN PATENT DOCUMENTS

| | | |
|---|---|---|
| CN | 201559519 | 8/2010 |
| CN | 102186675 | 9/2011 |
| JP | 2013212652 | 10/2013 |

* cited by examiner

IDENTIFYING FIRST AND SECOND RESERVOIR STATUSES

BACKGROUND

Devices, such as printers, may be used for extended production runs, resulting in increased need to halt production to change empty printing fluid supplies. Furthermore, devices may be exposed to undesirable situations, such as shocks received during shipment and/or use, issues with subassembly failure, parts becoming disconnected, damage to electronics, and so on that may result in a failure condition.

BRIEF DESCRIPTION OF THE DRAWINGS/FIGURES

DETAILED DESCRIPTION

Examples described herein enable refills of printable composition to be performed efficiently (e.g., without a need for a check valve) based on mathematical analysis of a single sensor to assess status of two different reservoirs of printable composition, and enable diagnostics to be performed during device operation to assess device status. In an example, a printer may perform a refilling procedure while monitoring a single pressure sensor, without a need for a plurality of sensors to be dedicated to a plurality of reservoirs. As used herein, the term printer includes two-dimensional printers based on inkjet, laser, and the like, as well as three-dimensional printers based on additive, subtractive, or other technologies including cumulatively printing onto a bed of build materials. Thus, various example devices increase printer availability and/or productivity, and enhance efficiency, consistency, and cost savings.

Figure 1:
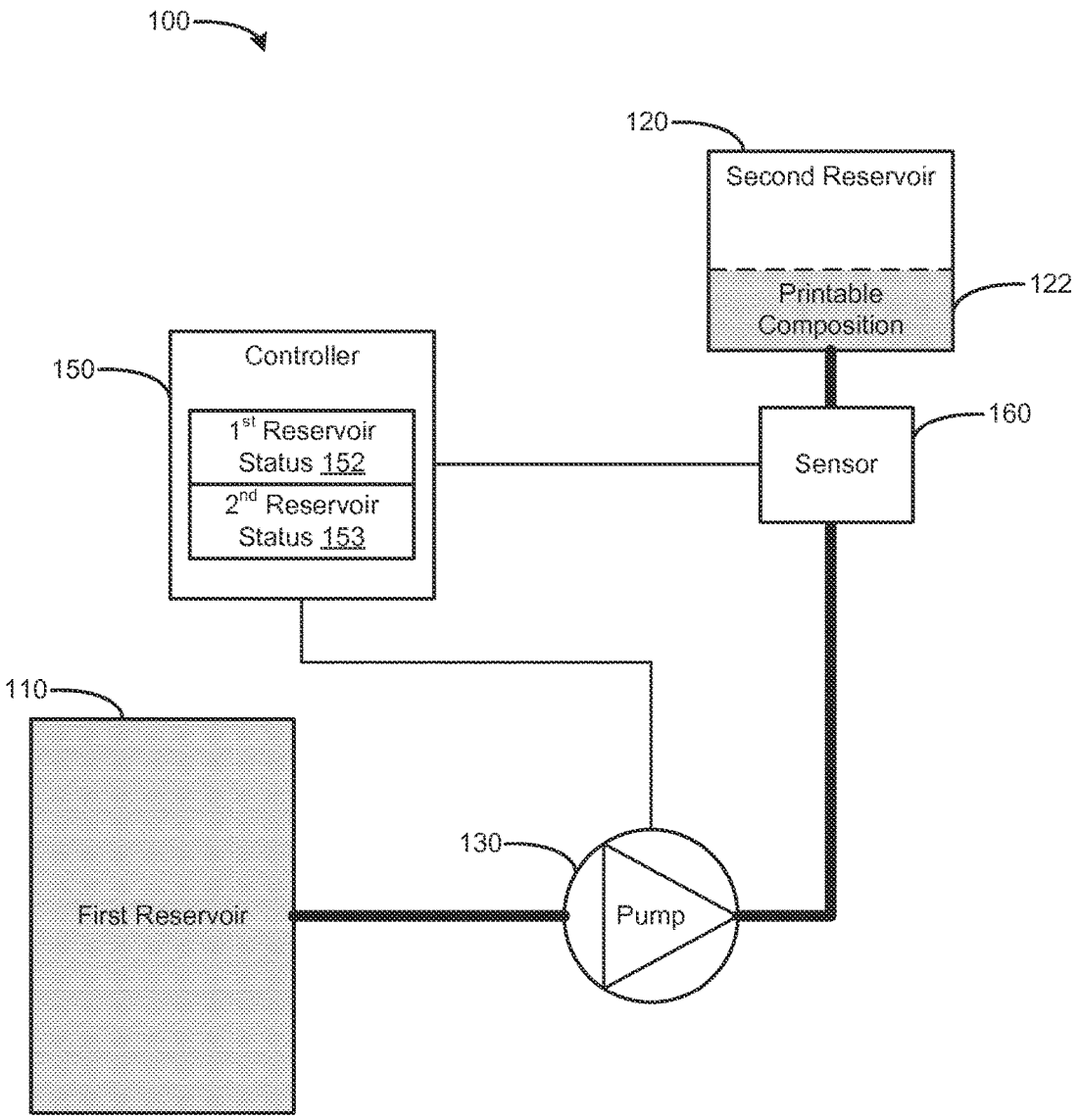
FIG. 1 is a block diagram of a device including a first reservoir and a second reservoir according to an example.

FIG. 1 is a block diagram of a device 100 including a first reservoir 110 and a second reservoir 120 according to an example. The device 100 also includes a pump 130, a sensor 160, and a controller 150. The first reservoir 110 is fluidically coupled to the second reservoir 120 via the pump 130. The first and second reservoirs 110, 120 are to provide and/or store a printable composition 122. The controller 150 is to identify, based on the single sensor 160, a first reservoir status 152 of the first reservoir 110, and a second reservoir status 152 of the second reservoir 120. The controller is also to selectively cause the pump 130 to operate to use the sensor 160 to identify the first and second statuses 152, 153.

The example device 100 may be a printer having a plurality of reservoirs to handle a type of the printable composition 122, such as a colored printing fluid. Thus, a device 100 may include a plurality of types of printable composition 122, and a type of the printable composition

122 may be associated with a pump 130 to fluidically couple the first reservoir 110 to the second reservoir 120. The printable composition 122 may thereby be pumped from the first reservoir 110, serving as a source of printable composition 122, to refill the second reservoir 120 according to the controller 150. Further, a pump 130 may include a plurality of inlets and outlets to provide pumping for a plurality of additional first reservoirs 110 and second reservoirs 120, not shown in FIG. 1 (e.g., the pump 130 may be a peristaltic pump to drive a bank of different colored printing fluids and corresponding first/second reservoirs 110, 120). The example device 100 may include a tub (not shown) to enclose the first reservoir(s) 110 and contain any leakage of the printable composition. The device 100 includes a hydraulic system topology, whereby the second reservoir 120 may be positioned at a greater height than the first reservoir 110 to enable gravity to affect fluid flow of the printable composition 122.

The first reservoir 110 may serve as a source of the printable composition 122. For example, the first reservoir 110 may supply a relatively large volume of printable composition 122, which is used to perform multiple refills of the relatively smaller second reservoir 120. In an example, the first reservoir 110 may be provided as a 3000 cubic centimeter (cc) printing fluid cartridge, installed at the device 100 and enabling enhanced autonomy due to its large capacity, to avoid a frequent need to replace/replenish the printable composition 122. In examples, the first reservoir 110 may include a sealed bladder/bag that is not open to the air, to store the printable composition 122. Accordingly, in such examples, as the first reservoir 110 approaches empty, this may result in increased flow resistance, such that a pressure pulse signal experienced by the pump 130 attenuates over time until the pressure pulse signal ceases. In alternate examples, the first reservoir 110 may be based on a non-sealed or otherwise open-to-air approach. In such an open approach, the pressure pulse signal may experience a different characteristic behavior (e.g., ramping off asymptotically or otherwise attenuating in a characteristic manner suited to the particular open reservoir.

The second reservoir 120 may hold the printable composition 122 for printing. In an example, the second reservoir 120 may be provided as a refillable printing fluid cartridge having a relatively smaller capacity (e.g., 775 cc) than the first reservoir 110. In an alternate example, the second reservoir 120 may be provided as an inkjet cartridge including a print head, which is fluidically coupled to the first reservoir 110 for refills.

The first and second reservoirs 110, 120 may be positioned at different locations in the device 100. For example, the first reservoir 110 may be positioned out of the way in a lower part of the device 100, in a location convenient for catching printing fluid spillage that would make its way downward. The printable composition 122 may be pumped by the pump 130 to refill the second reservoir 120, as the printable composition 122 is exhausted from the second reservoir 120 by printing. Thus, the second reservoir 120 may serve as an intermediate storage tank to accommodate printing (e.g., oscillating back and forth along with a print head of an inkjet printer device), which may be refilled from the first reservoir 110.

The printable composition 122 may be an ink, printing fluid, pigment, dye, toner, sintering powder, or other printable composition, including compositions compatible with two-dimensional (2D) and three-dimensional (3D) printing technologies. In an example, the printable composition 122 may be a printing fluid compatible with inkjet printing technology.

The pump 130 may be compatible with pumping the printable composition. In some examples, the pump 130 may be an eccentric diaphragm pump. The pump 130 may controlled by the controller 150, by selectively applying power (e.g., by selectively applying, over time, a given duty cycle to the pump 130). In an example, the controller 150 may power a pump driver (not specifically shown, may be incorporated in the controller 150 and/or the pump 130) using a high voltage rail (e.g., 12 volts or 24 volts), in contrast to a power supply voltage rail (e.g., 3.3 volts) to supply power for, e.g., logic control of the controller 150 and/or sensor 160 etc. The pump driver may include a two-step switch, such as metal-oxide semiconductor field-effect transistors (MOSFETs) and/or low power transistors (bipolar junction transistors (BJT)) to provide pulse-width modulated (PWM) signals generated by the controller 150 for controlling the pump 130 via a duty cycle. In some examples, the controller 150 may apply pump voltage to the pump 130 based on the example formula Vpump=(Duty cycle)*V1, where V1 is the high voltage rail value. Additional circuitry (e.g., transistor(s)) may be used to adapt signals/voltages from the high voltage rail to the power supply voltage rail and vice versa.

The controller 150 may provide controlled transfer of printable composition 122 from the first reservoir 110 to the second reservoir 120, e.g., by controlling the pump 130 by identifying a status of the sensor 160 to determine statuses of the first and second reservoirs 110, 120. The controller 150 may include and/or refer to a table of stored values corresponding to acceptable statuses of the sensor 160 and/or pump 130, including voltages, currents, and pressures corresponding to the pump 130 and/or sensor 160. Thus, the controller 150 may identify existing sensed values, compare them to stored/desired values, and adjust accordingly to ensure the controlled refill of the second reservoir 120. Additionally, the controller 150 may identify values for diagnostic purposes, such as identifying whether there is a malfunction with the pump 130 or the reservoirs 110, 120. For example, the controller 150 may identify combinations of values that contradict each other, such as a high pump voltage and/or current, but a low resulting pressure that would normally be indicative of the pump not receiving high pump voltage/current.

The controller 150 may vary pumping of the pump 130 to optimize refilling of the second reservoir 120. For example, the controller 150 may detect that a new/filled first reservoir 110 is connected, and that the second reservoir 120 is empty. Thus, the controller 150 may initially pump the printable composition 122 to the second reservoir 120 at high rate based on a first duty cycle, frequently over time. After some time, the controller 150 may reduce the pumping rate to a low value for a short time, according to a second duty cycle and/or less frequent periods of pumping at a given duty cycle. Such an approach may be repeated, adjusting the pump rate according to a duty cycle and/or frequency to maximize filling speed where appropriate, and maximize control where appropriate. For example, when the sensor indicates that there is a relatively small amount of room remaining as the second reservoir 120 become full, the controller 150 may operate the pump 130 according to infrequent and/or shorter intervals, to avoid risk of over-pressure and/or printing fluid spillage. In examples, the controller 150 may control/trigger the pump 130 based on using drop counting information (e.g., drop counting at the second reservoir 120), to track printing fluid consumption and usage from the second reservoir 120. In alternate examples, the pump 130 may be controlled based on other techniques besides duty cycle, such as amplitude modulation, frequency modulation, pulse-width modulation, and other approaches (e.g., analog voltage and/or current controllers).

The single sensor 160 thus may be used to identify and control the level of printable composition 122 in two different tanks, the first and second reservoirs 110, 120. Thus, the controller 150 may identify the first and second reservoir statuses 152, 153 to refill the second reservoir 120 from the first reservoir 110, by identifying the signal of a single sensor 160 in the device 100.

Figure 2:
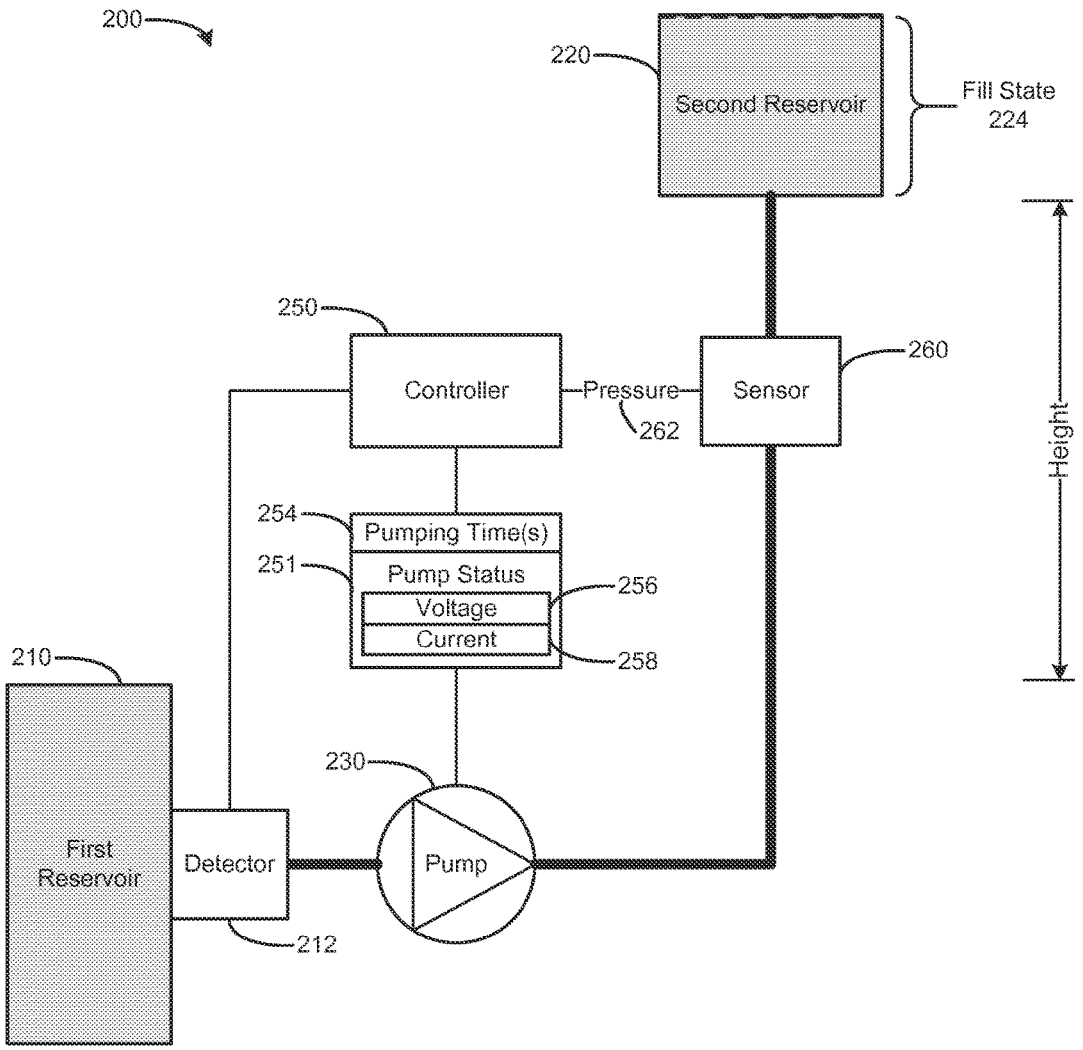
FIG. 2 is a block diagram of a device including a first reservoir and a second reservoir according to an example.

FIG. 2 is a block diagram of a device 200 including a first reservoir 210 and a second reservoir 220 according to an example. The second reservoir 220 is associated with a fill state 224. The device 200 also includes a detector 212, a pump 230, a controller 250, and a sensor 260. The first reservoir 210 is fluidically coupled to the second reservoir 220 via the pump 230. The detector 212 may indicate whether the first reservoir 210 is coupled to the device 200. The controller 250 is to identify a pressure 262 (to determine status of the first and second reservoirs 210, 220), as indicated by the sensor 260, and identify a pump status 251 based on a voltage 256 and/or a current 258. The controller 250 is to selectively cause the pump 230 to operate according to a pumping time(s) 254 and/or other controllable features such as a duty cycle, voltage 256, and/or current 258.

The detector 212 may perform presence detection of the first reservoir 210. In an example, the detector 212 may be provided as a mechanical switch including a voltage divider that may be embedded in a switch controller at the detector 212 (and/or may be incorporated in controller 250). The presence detection provided by detector 212 may enable hardware protection, e.g., to prevent the pump 230 from pumping air into the printing fluid tubes when the first reservoir 210 is not connected to the device 200. Thus, lack of detection by detector 212 may be used to halt pumping operations or other (e.g., diagnostic) activities, and a message may be issued for the first reservoir 210 to be connected in order to proceed.

The controller 250 may identify a status of various components/systems of device 200, including whether they work properly, whether the first reservoir 210 is connected, whether the first reservoir 210 and/or the second reservoir 220 have printing fluid or are empty, whether the pump 230 is malfunctioning, and so on. In examples, the controller 250 may identify the pressure 262 based on sensor 260 installed in the device 200, according to whether the pump 230 is pumping or not, and the corresponding different pressure sensor signals. A type of signal from the sensor 260 may be expected according to pump status 251 (e.g., a pressure in the printable composition tubes, based on how the pump 230 is being operated according to voltage 256 and/or current 258), and if that signal is identified, the controller 250 may determine that the device 200 is working properly. However, if a signal from the sensor 260 is not expected in view of the status of the various other systems, the controller 250 may identify an issue, even if the issue is caused by components that are not directly monitored (e.g., passive components) by the controller 250.

The sensor 260 may be used to identify the status of the first reservoir 210 and/or the second reservoir 220 based on pressure 262 that develops in the lines between the pump 230 and the second reservoir 220. Thus, as printable composition (e.g., printing fluid) is pumped into the second reservoir 220, pressure 262 develops accordingly. As the pump 230 is paused, the pressure 262 assumes a different state, also indicative of a status of the first and/or second reservoirs 210, 220. Further, a height of the second reservoir 220, relative to the device 200, the sensor 260, the first reservoir 210, etc., may be established by the device 200. The height (as well as the relative position of the sensor 260) may be factored into the status identification performed by the controller 250. For example, the controller 250 may identify whether the second reservoir 220 is empty and should be filled rapidly, is approaching a threshold fill state 224 and should be filled more slowly, or has reached the threshold fill state 224 and should not be filled any more. Similarly, the controller 250 may identify, based on the sensor 260, that the first reservoir 210 is empty, such that pumping should be paused until the first reservoir 210 is refilled.

The sensor 260 may be provided by various types of pressure sensors, which are compatible with identifying pressure developed by the printable composition. In some examples, the sensor also may detect whether the printable composition is undergoing movement and/or flow through the printable composition tubes. For example, the sensor 260 may be provided as a differential pressure sensor, whose status the controller 250 may read independently of the pump status 251 and detector 212 status. The sensor 260 output may be mathematically analyzed, e.g., by taking an average reading and/or identifying a variance (e.g., by taking a standard deviation reading, tracking signal amplitude such as peak to valley, using root mean square (RMS), and so on) of the pressure 262 over time.

The controller 250 may control the pump 230, and also may identify various characteristics of the pump 230, e.g., for diagnostic purposes. In an example, the controller 250 may identify a pump status 251 based on the current 258. The current 258 associated with the pump 230 may be obtained as an indication of current flowing through windings of the pump windings, e.g., by using a shunt resistor and instrumentation amplifier (not shown). The current 258 may be obtained in series with a pump motor driver (not shown; may be incorporated with the pump 230 and/or controller 250), and may be obtained independent of other measurements such as those for the detector 212 and the sensor 260.

Thus, the controller may perform diagnostics and check whether device systems are working correctly. For example, if the printable composition is available, the pump 230 is pumping properly, and signals for pressure 262, detector 212, and pump status 251 are within expected ranges, the controller 250 also may infer that the mechanical aspects, such as fluid lines and couplings, also are working properly. In an example situation that may indicate improper status or operation, the pump status 252 may indicate operation of the pump 230, but yet the sensor 260 may indicate a lack of pressure 262. Such a situation may be consistent with an issue in at least one part of the passive components (e.g., a fluid coupling may be disconnected, allowing pumped printable composition to spill out instead of passing by the sensor 260).

Figure 3:
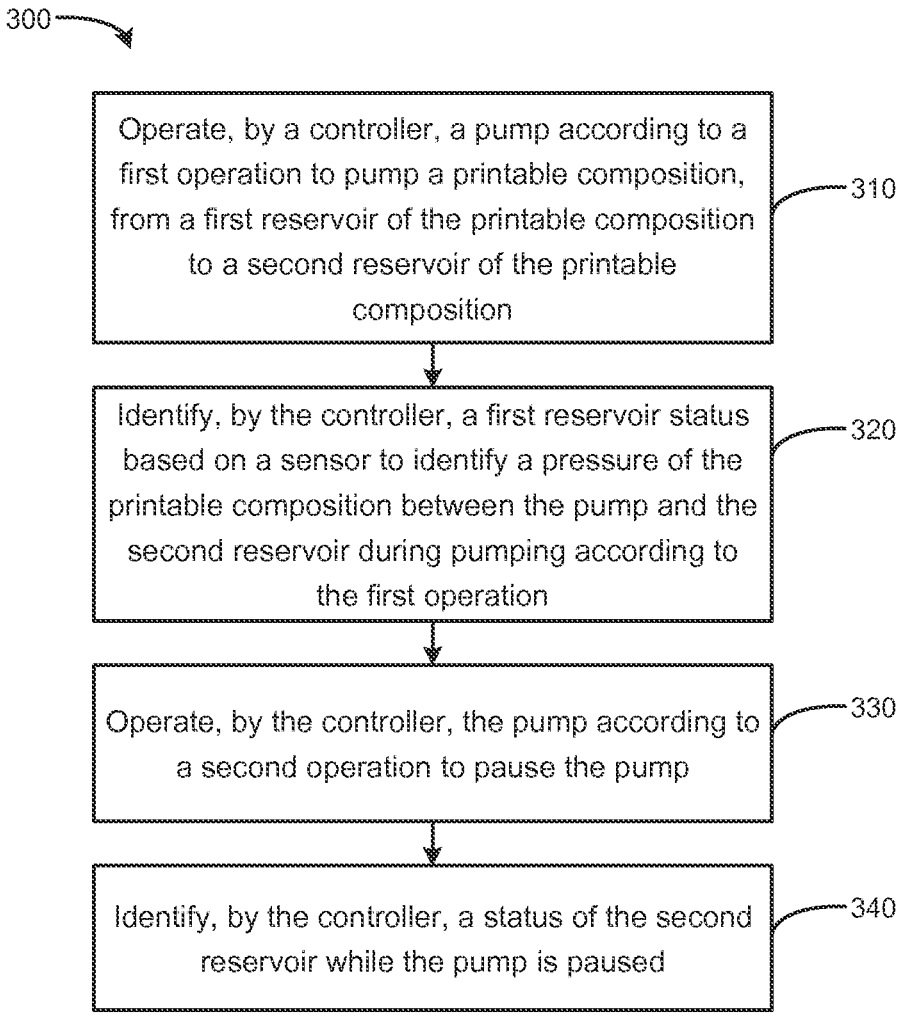
FIG. 3 is a flow chart based on identifying first and second reservoir statuses according to an example.

FIG. 3 is a flow chart 300 based on identifying first and second reservoir statuses according to an example. In block 310, a controller is to operate a pump according to a first operation to pump a printable composition, from a first reservoir of the printable composition to a second reservoir of the printable composition. For example, the controller may perform a plurality of sensor readings over time while pumping, and mathematically analyze the plurality of readings to identify a variance (e.g., standard deviation, RMS, etc.) of the signal over time. In block 320, the controller is to identify a first reservoir status based on a sensor to identify a pressure of the printable composition between the pump and the second reservoir during pumping according to the first operation. For example, the controller may compare the variance so obtained to a threshold value, and consider the first reservoir as being empty if the value obtained from the sensor falls below the threshold. In block 330, the controller is to operate the pump according to a second operation to pause the pump. For example, the controller may operate the pump according to intervals of pumping and pausing, to obtain a plurality of pressure signals over time during periods of pumping and/or periods of pausing/not pumping. In block 340, the controller is to identify a status of the second reservoir while the pump is paused. For example, the controller may read the sensor during the plurality of pauses to identify an average sensor pressure over time during the pauses. By identifying changes in the variance (e.g., standard deviation etc.) and/or average of pressures over time, example devices may identify whether the first reservoir is empty and/or whether the second reservoir is full.

Figure 4:
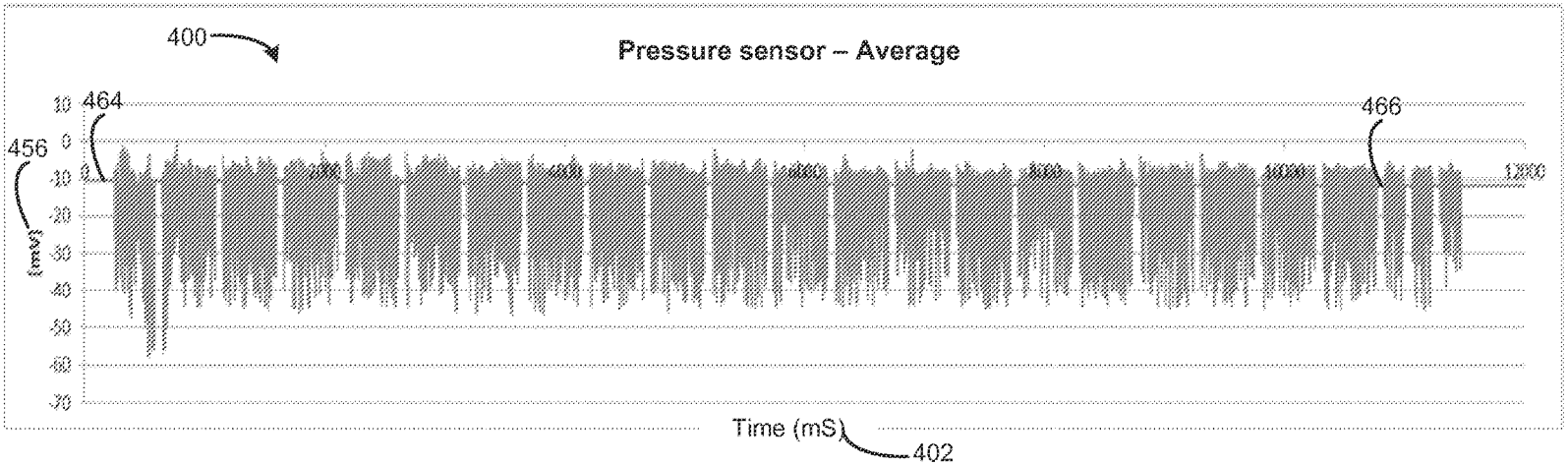
FIG. 4 is a diagram of voltage vs. time for average pressure according to an example.

FIG. 4 is a diagram 400 of voltage 456 vs. time 402 for an average of pressures 464, 466 according to an example. The information of FIG. 4 may be used to identify a fill status of the second reservoir. As shown, the signal includes pulses of noisy sensor data interspersed with pulses of constant sensor data. This corresponds to noisy periods of operating the pump, and constant periods of pausing the pump, resulting in pulses. The lines (between the noisy pulses) represent the static moments where the pressure sensor may be read for the purpose of identifying pressure readings to identify whether the second reservoir is full. The pressure during the static moments begins at first pressure 464, shown as approximately −10 millivolts. Over time 402, the static pressure value gradually decreases in amplitude, toward the second pressure 466 shown as approximately −8 millivolts. This corresponds to the second reservoir approaching a full status. Furthermore, the width of the pulses of pump activity decrease toward the end of the chart. Specifically, the final three pulses are reduced in width compared to the first 21 pulses. This corresponds to the system recognizing that the second reservoir is approaching a full status (based on the approach of the static regions toward the second pressure 466), and using a shorter pumping duration (e.g., PumpingTime of block 770 in FIG. 7) to avoid risk of overfilling the second reservoir. When that static level between the noisy pulses reaches a certain threshold value in millivolts, the system can declare the second reservoir full.

Figure 5:
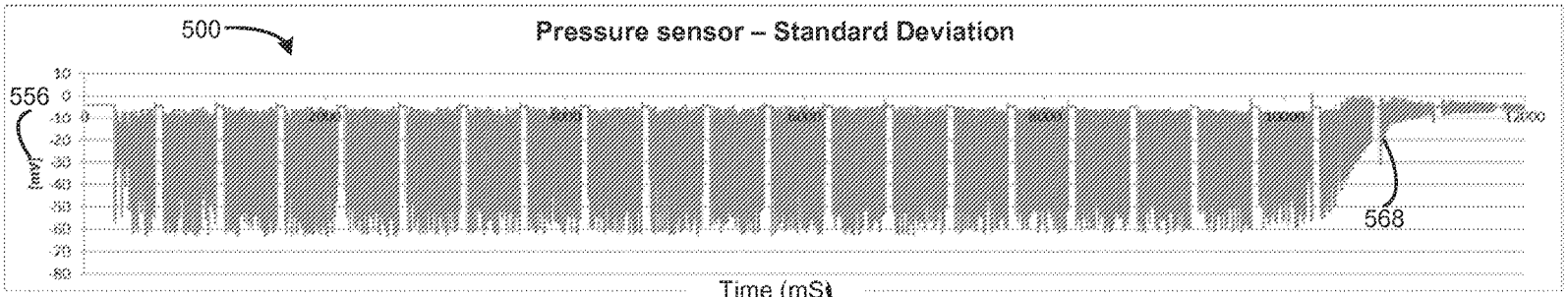
FIG. 5 is a diagram of voltage vs. time for standard deviation of pressure according to an example.

FIG. 5 is a diagram 500 of voltage 556 vs. time 502 for standard deviation 568 of pressure according to an example. Information shown in FIG. 5 may be used to identify whether the first reservoir is running out of printable composition/printing fluid. The standard deviation is shown as one of various techniques of identifying a variance of the signal, where the variance to be identified is generally expressed as an attenuation of the signal over time. In alternate examples, other mathematical techniques may be used to find the variance and/or attenuation of the signal, such as by tracking signal amplitude (e.g., peak-to-valley), RMS, and the like. Furthermore, the change in the pressure signal over time may be particular to a given implementation of the first reservoir (e.g., whether sealed/closed or non-sealed/open-to-air). Accordingly, the pressure signal can be checked for attenuation corresponding to a pattern suitable for a given first reservoir, even if the signal does not attenuate as aggressively toward zero as shown in FIG. 5. The standard deviation values show a decrease over time in the amplitude of the noisy pulses corresponding to when the pump is pumping. Toward the end of the chart, where indicated at standard deviation value 568, the amplitude of the standard deviation signal has decreased below a threshold amplitude, indicating a pattern that the controller can correlate to the first reservoir being depleted of printing fluid.

Figure 6:
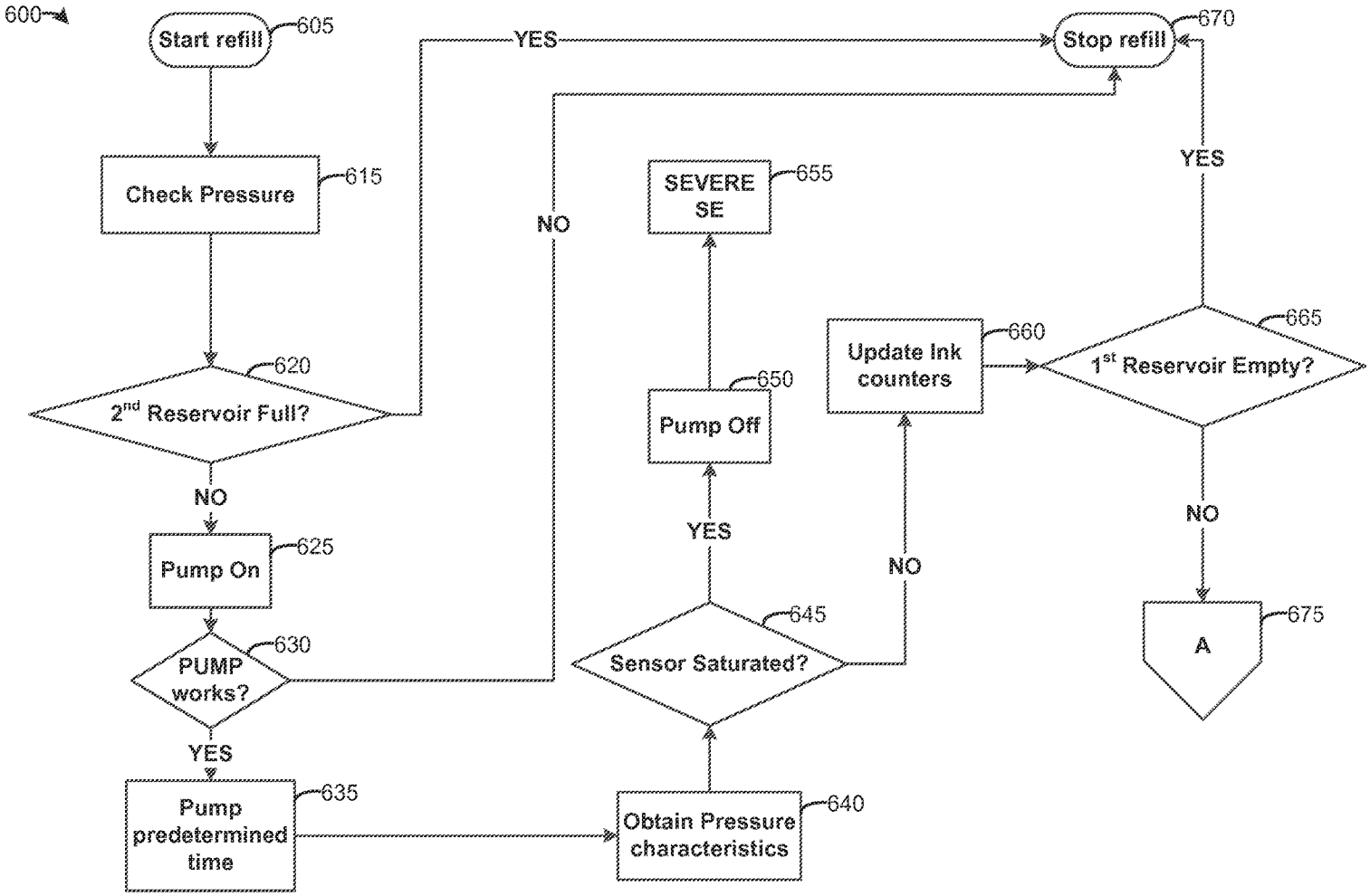
FIG. 6 is a first part of a flow chart based on identifying first and second reservoir statuses according to an example.
Figure 7:
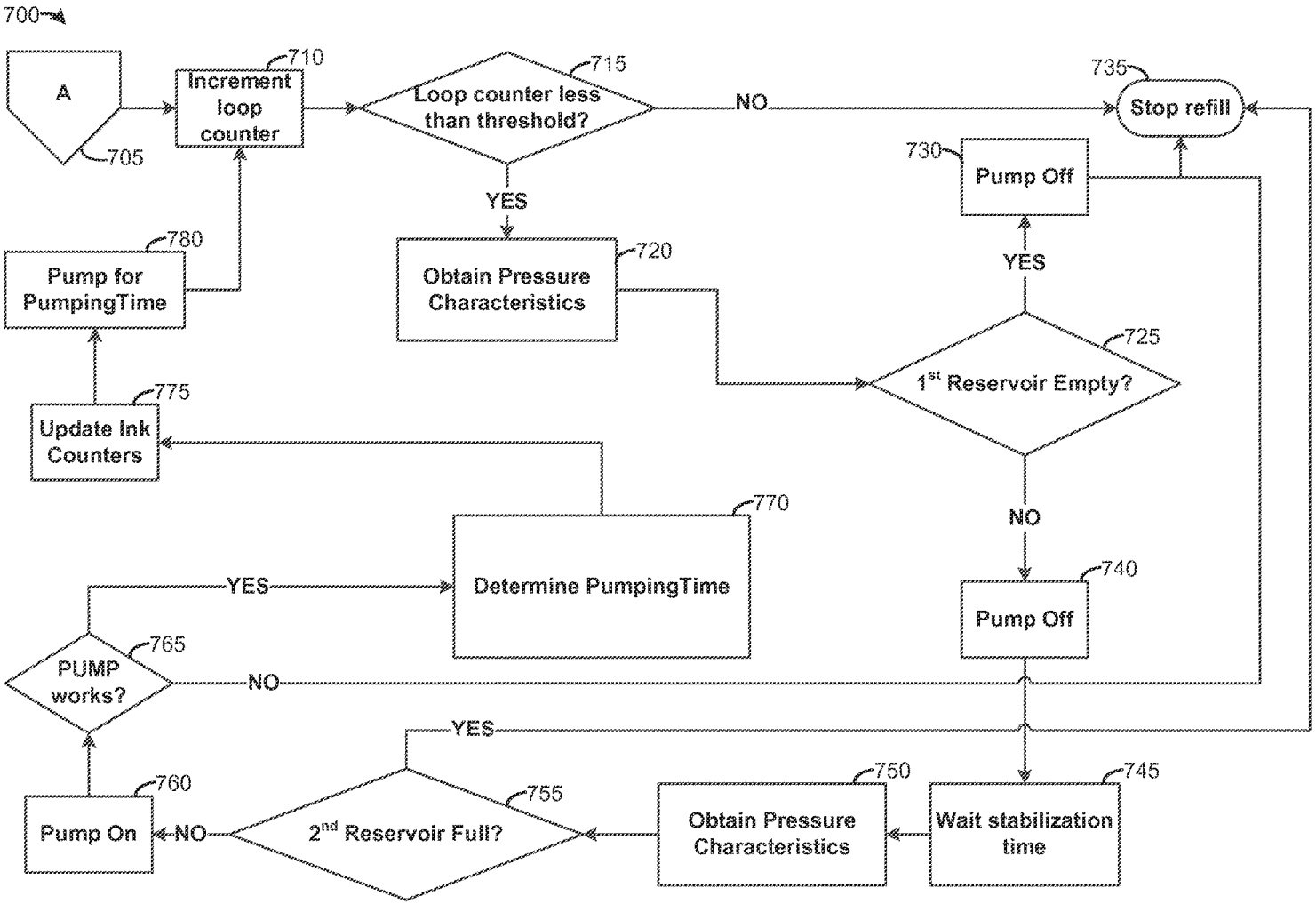
FIG. 7 is a second part of a flow chart based on identifying first and second reservoir statuses according to an example.

Referring to FIGS. 6 and 7, flow diagrams are illustrated in accordance with various examples of the present disclosure. The flow diagrams represent processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 6 is a first part 600 of a flow chart based on identifying first and second reservoir statuses according to an example. The flow chart may be used with reference to the device of FIGS. 1 and 2. The flow chart 600 enables a device to obtain initial device/sensor measurements, detect whether a device malfunction is present, and begin the refill cycles to fill the second reservoir. The refill procedure starts at block 605. Example systems are operable without a need to depressurize. However, although not specifically shown, in alternate examples, an air pressurized system of a printer device may be depressurized. In block 615, the pressure is checked. For example, a controller can identify the output of a pressure sensor fluidically coupled between first and second reservoirs. The controller can perform a plurality of measurements over time to obtain an average pressure and a variance (e.g., standard deviation). In an example, the controller may perform fifty measurements, where each measurement is taken for 20 milliseconds. The pressure may be checked as a static pressure, e.g., when the pump is paused (or off) and not pumping, to avoid the presence of noise in the pressure signal. In block 620, it is checked whether the second reservoir is full. For example, the controller may check whether the average pressure is less than a threshold amount. The threshold may be provided as a function of first and/or second pressures 464, 466 as illustrated in FIG. 4 (e.g., static pressures during pauses between pumping). If the second reservoir is full, flow proceeds to block 670 where refill stops. If, in block 620, it is determined that the second reservoir is not full, flow proceeds to block 625.

In block 625, the controller turns on the pump. For example, the controller operates the pump at a given duty cycle (for an amount of time identified at block 635). In block 630, the controller is to identify that the pump works. For example, the controller may apply a given current to the pump, and check whether the pump short circuits or fails to consume any power. In an alternate example, the controller may apply a given duty cycle to the pump, and check the sensor for characteristic pressure noise generated by the pump corresponding to the duty cycle. If the pump does not work, flow proceeds to block 670 where the refill procedure stops. If, at block 630, it is determined that the pump works, flow proceeds to block 635. In block 635, the controller directs the pump to pump for a predetermined time. For example, the predetermined time may be five seconds to allow the pump to operate and provide consistent pressure during pumping. In block 640, the controller is to obtain pressure characteristics during pumping. For example, the controller may obtain the pressure characteristics during the predetermined time, and/or wait until the predetermined time has passed, and then continue pumping to obtain the pressure characteristics. In an example, the controller may obtain an average pressure and a variance (e.g., standard deviation) pressure reading over a plurality of intervals (e.g., fifty measurements for 20 milliseconds per measurement), while the pump is pumping.

In block 645, it is determined whether the sensor is saturated. For example, the controller can check whether the average pressure (e.g., as collected at block 640), is above an upper sensor saturation threshold, or below a lower sensor saturation threshold. If saturated, the pump is shut off in block 650, and a severe system error is indicated at block 655. For example, the controller may halt pumping operations and provide a notification that the device needs service intervention. If, at block 645, it is determined that the sensor is not saturated, flow proceeds to block 660. In block 660, printing fluid counters are updated. For example, the controller my update its counts corresponding to printing fluid levels for the first and/or second reservoirs. In an alternate example, the printing fluid counters may be stored as variables in firmware of an inkjet cartridge, such as an acumen anti counterfeit chip used to track printing fluid supplies and prevent counterfeit refills. In block 665, it is determined whether the first reservoir is empty (e.g., based on at least one of the obtained pressure characteristics from block 640). For example, the controller may determine whether the pressure variance is less than a threshold value, such as a value 568 of FIG. 5 indicating a drop-off in the variance. In alternate examples, the threshold value may be an absolute value, such as −3.0 mV. If the first reservoir is indicated as empty, flow proceeds to block 670 where the refill stops. If, at block 665, it is determined that the first reservoir is not empty, flow proceeds to block 675 "A." The first part of the flow chart continues at the second part, starting at block 705 "A" shown in FIG. 7.

FIG. 7 is a second part 700 of a flow chart based on identifying first and second reservoir statuses according to an example. Flow starts at block 705 "A" (continued from "A" of FIG. 6). In block 710, a loop counter is incremented. For example, the device may track a number of loops for which blocks 710-780 of the flowchart 700 have been performed. In block 715, the controller is to determine whether the loop counter is less than a threshold loop value. For example, the system may use the loop threshold as a security measure to avoid being stuck in a refill loop (e.g., when a problem exists that prevents proper refill from occurring). As an example, the loop threshold may be 70 loops, whereas a given refill may take on the order of 20 loops. If the loop counter is not less than the loop threshold, the refill procedure is stopped at block 735. If, in block 715, it is determined that the loop counter is less than the loop threshold, flow proceeds to block 720. In block 720, the controller is to obtain pressure characteristics. For example, the controller obtains the average and variance pressure characteristics while pumping. In block 725, it is determined whether the first reservoir is empty. For example, the controller may determine whether the pressure variance is less than a threshold value, such as a value 568 of FIG. 5 indicating a drop-off in the variance. In alternate examples, the threshold value may be an absolute value, such as −3.0 mV. If the first reservoir is indicated as empty, flow proceeds to block 730 where the pump is turned off and block 735 where the refill stops. If, at block 725, it is determined that the first reservoir is not empty, flow proceeds to block 740 where the pump is turned off.

In block 745, the controller is to wait for fluid to stabilize. For example, the controller may introduce a wait time of 500 milliseconds to allow the ink/printable composition to stabilize after shutting off the pump at block 740. In block 750, the controller is to obtain pressure characteristics while the pump is static. For example, the controller obtains the average and variance pressure characteristics while not pumping. In block 755, it is checked whether the second reservoir is full. For example, the controller may check whether the average pressure is less than a threshold amount. The threshold may be provided as a function of first and/or second pressures 464, 466 as illustrated in FIG. 4 (e.g., static pressures during pauses between pumping). If the second reservoir is full, flow proceeds to block 735 where refill stops. If, in block 755, it is determined that the second reservoir is not full, flow proceeds to block 760. In block 760, the pump is turned on. In block 765, it is determined whether the pump works. For example, the controller may apply a given current to the pump, and check whether the pump short circuits or fails to consume any power. In an alternate example, the controller may apply a given duty cycle to the pump, and check the sensor for characteristic pressure noise generated by the pump corresponding to the duty cycle. If the pump does not work, flow proceeds to block 735 where the refill procedure stops. If, at block 765, it is determined that the pump works, flow proceeds to block 770. In block 770, the PumpingTime is determined. For example, the pumping time may be expressed as a function of how close the second reservoir is to being full, based on a difference between an average pressure at the sensor, and a second pressure 466 of FIG. 4 corresponding to a full reservoir. The pumping time may be set to various values depending how close to full the average pressure is. For example, the PumpingTime may be set to 5 seconds if the second reservoir is within 10% of being full, or 3 seconds if the second reservoir is within 5% of being full (or other values suitable to a given implementation, reservoir, or pump size/capacity). Otherwise, the PumpingTime may be set to 10 seconds, for example. Thus, the system may fine-tune the amount of time used for refills, to avoid a risk of overfilling the second reservoir as it approaches a full status. In block 775, the printing fluid counters are updated. For example, the controller my update its counts corresponding to printing fluid levels for the first and/or second reservoirs. In an alternate example, the printing fluid counters may be stored as variables in firmware of an inkjet cartridge, such as an acumen anti counterfeit chip used to track printing fluid supplies and prevent counterfeit refills. In block 780, the device is to pump for the duration of PumpingTime. For example, the system may pump during the PumpingTime found at block 770, before proceeding to complete a loop and return to block 710.

The flowcharts of FIG. 7 and FIG. 8 may apply for an individual color/line of ink/printable composition. However, a printer may contain multiple supplies to be refilled individually (e.g., using an independent firmware thread), and each may be refilled according to its own set of flowchart.

Examples provided herein may be implemented in hardware, software, or a combination of both. Example systems can include a processor and memory resources for executing instructions stored in a tangible non-transitory medium (e.g., volatile memory, non-volatile memory, and/or computer readable media). Non-transitory computer-readable medium can be tangible and have computer-readable instructions stored thereon that are executable by a processor to implement examples according to the present disclosure.

An example system (e.g., a computing device) can include and/or receive a tangible non-transitory computer-readable medium storing a set of computer-readable instructions (e.g., software). As used herein, the processor can include one or a plurality of processors such as in a parallel processing system. The memory can include memory addressable by the processor for execution of computer readable instructions. The computer readable medium can include volatile and/or non-volatile memory such as a random access memory ("RAM"), magnetic memory such as a hard disk, floppy disk, and/or tape memory, a solid state drive ("SSD"), flash memory, phase change memory, and so on.

What is claimed is:

1. A device comprising:

a first reservoir to serve as a source of a printable composition;

a pump fluidically coupled to the first reservoir and a second reservoir to pump the printable composition from the first reservoir to the second reservoir, wherein the second reservoir is to store the printable composition;

a sensor fluidically coupled between the pump and the second reservoir; and a controller to direct the pump according to a first operation to identify a first reservoir status based on the sensor, and to direct the pump according to a second operation to identify a second reservoir status based on the sensor.

2. The device of claim 1, wherein the sensor is to identify a pressure associated with the printable composition between the pump and the second reservoir, and wherein the controller is to identify the status of the first and second reservoirs based on the pressure.

3. The device of claim 2, wherein during the second operation the pressure identified by the sensor is to correspond to a fill state of printable composition of the second reservoir.

4. The device of claim 3, wherein the second operation includes pausing the pump and identifying an average pressure.

5. The device of claim 4, wherein the second operation includes waiting for a stabilization time before identifying the average pressure.

6. The device of claim 4, wherein the average pressure is identified based on performing a plurality of pressure measurements over time while the pump is paused.

7. The device of claim 3, wherein the fill state of the second reservoir is identified as full based on the average pressure reaching a threshold pressure.

8. The device of claim 2, wherein during the first operation the pressure identified by the sensor is to correspond to a fill state of printable composition of the first reservoir.

9. The device of claim 8, wherein the first operation includes identifying a variance of the pressure while pumping.

10. The device of claim 9, wherein the variance is identified based on performing a plurality of pressure measurements over time while pumping to obtain a standard deviation.

11. The device of claim 9, wherein the fill state of the first reservoir is identified as empty based on the variance falling below a threshold.

12. The device of claim 1, wherein the controller is to identify a pumping time for refilling the second reservoir from the first reservoir based on how close the second reservoir is to a full status, wherein the pumping time is inversely related to how close the second reservoir is to a full status.

13. A device comprising:

a first reservoir to serve as a source of a printable composition;

a second reservoir to store the printable composition, wherein the second reservoir is positioned at a greater height relative to the first reservoir;

a pump fluidically coupled to the first reservoir and to the second reservoir, to pump the printable composition from the first reservoir to the second reservoir;

a sensor fluidically coupled between the pump and the second reservoir, to identify a pressure associated with the printable composition between the pump and the second reservoir; and a controller to direct the pump according to a first operation to identify a first reservoir status based on the pressure, and to direct the pump according to a second operation to identify a second reservoir status based on the pressure.

14. A method, comprising:

operating, by a controller, a pump according to a first operation to pump a printable composition, from a first reservoir of the printable composition to a second reservoir of the printable composition;

identifying, by the controller, a first reservoir status based on a sensor to identify a pressure of the printable composition between the pump and the second reservoir during pumping according to the first operation;

operating, by the controller, the pump according to a second operation to pause the pump; and identifying, by the controller, a status of the second reservoir while the pump is paused.

15. The method of claim 14, further comprising identifying a difference between the second status and a threshold fill state of the second reservoir, and operating the pump according to a plurality of time periods inversely proportional to the difference between the second status and a threshold fill state of the second reservoir.

16. The device of claim 1, wherein the second reservoir is positioned at a greater height than the first reservoir.

17. The device of claim 16, wherein a difference in height between the first and second reservoirs is used by the controller in identifying the reservoir status of the reservoirs.

18. The device of claim 1, the controller to compare sensed values output by the sensor to stored values to determine adjustments to filing of the second reservoir from the first reservoir.

19. The device of claim 1, the controller to operate the pump at a less frequent or shorter interval when the sensor indicates that the second reservoir is approaching a full status to avoid overpressure or spillage.

20. The device of claim 1, further comprising a detector to indicate when the first reservoir is coupled to the device, the controller halt operation of the pump when the first reservoir is not coupled to the device.

* * * * *